US008967276B2

(12) United States Patent
Mazyar et al.

(10) Patent No.: US 8,967,276 B2
(45) Date of Patent: Mar. 3, 2015

(54) NON-BALLISTIC TUBULAR PERFORATING SYSTEM AND METHOD

(75) Inventors: Oleg A. Mazyar, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 402 days.

(21) Appl. No.: 13/352,969

(22) Filed: Jan. 18, 2012

(65) Prior Publication Data

US 2013/0180725 A1 Jul. 18, 2013

(51) Int. Cl.
*E21B 29/00* (2006.01)
*E21B 43/26* (2006.01)

(52) U.S. Cl.
USPC ..... 166/376; 166/296; 166/317; 166/281

(58) Field of Classification Search
USPC ..... 166/296, 281, 376, 317
See application file for complete search history.

(56) References Cited

U.S. PATENT DOCUMENTS

| | | | | |
|---|---|---|---|---|
| 3,273,641 | A * | 9/1966 | Bourne | 166/276 |
| 5,515,915 | A | 5/1996 | Jones et al. | |
| 6,619,398 | B2 | 9/2003 | MacKenzie et al. | |
| 6,662,873 | B1 * | 12/2003 | Nguyen et al. | 166/276 |
| 6,755,249 | B2 | 6/2004 | Robison et al. | |
| 6,834,725 | B2 | 12/2004 | Whanger et al. | |
| 7,243,732 | B2 | 7/2007 | Richard | |
| 7,318,481 | B2 | 1/2008 | Richard | |
| 7,392,852 | B2 | 7/2008 | Richard | |
| 7,578,347 | B2 | 8/2009 | Bosma | |
| 7,784,532 | B2 | 8/2010 | Sevre et al. | |
| 7,866,393 | B2 | 1/2011 | Badalamenti et al. | |
| 2004/0168804 | A1 | 9/2004 | Reddy et al. | |
| 2006/0207765 | A1 * | 9/2006 | Hofman | 166/313 |
| 2010/0300689 | A1 | 12/2010 | McRobb et al. | |
| 2010/0314111 | A1 | 12/2010 | Karcher et al. | |
| 2011/0077324 | A1 | 3/2011 | Ravi et al. | |
| 2011/0220359 | A1 | 9/2011 | Soliman et al. | |
| 2011/0226479 | A1 * | 9/2011 | Tippel et al. | 166/305.1 |
| 2012/0175134 | A1 | 7/2012 | Robisson et al. | |

FOREIGN PATENT DOCUMENTS

| | | | |
|---|---|---|---|
| AU | 2011218707 | A1 | 9/2011 |
| AU | 20110218707 | A1 | 12/2012 |
| WO | 2011131306 | A1 | 10/2011 |
| WO | 2011131307 | A1 | 10/2011 |

OTHER PUBLICATIONS

Bob Brooks, Tim Davis, Frank Delucia, Tam International, "Use of Swellable Elastomers to Enhance Cementation in Deep Water Applications," Paper Presentaton for Deep Offshore Technology Conference-International, Feb. 12-14, 2008, pp. 1-13, Houston.

"FracPoint MP Sleeve with DirectConnect Ports"; Baker Hughes Incorporated; Trade Show Material, 2012; 4 pages.

Brent Miller and John Paneitz, Whiting Petroleum Corporation, and Sean Yakely and Kent Evans, Baker Hughes, "Unlocking Tight Oil: Selective Multi-Stage Fracturing in the Bakken Shale," SPE Annual Technical Conference and Exhibition, Sep. 21-24, 2008, pp. 1-6, SPE 116105-MS, Society of Petroleum Engineers, Denver.

A.S. Metcalf et al., "Case Histories of Successful Acid Stimulation of Carbonate Completed With Horizontal Open Hole Wellbores"; Journal of Canadian Petroleum Technology, vol. 48, No. 6; Jun. 2006, 5 pages.

* cited by examiner

*Primary Examiner* — Kenneth L Thompson
(74) *Attorney, Agent, or Firm* — Cantor Colburn LLP

(57) ABSTRACT

A non-ballistic tubular perforating system includes a tubular having a wall with perforations therethrough, and plugs positioned within the perforations that are configured to dissolve in response to exposure to a first environment thereby creative of a second environment that can dissolve or increase porosity of cement.

23 Claims, 2 Drawing Sheets

NON-BALLISTIC TUBULAR PERFORATING SYSTEM AND METHOD

BACKGROUND

Opening perforations through walls of a tubular to allow fluid flow therethrough after deployment of the tubular within a structure is not uncommon. One method of opening such perforations is through ignition of ballistic devices, referred to as guns. Due to the explosive nature of the guns shipment of them through some jurisdictions is not permitted. The art is, therefore, always receptive to alternate methods of opening perforations in tubulars that do not require guns.

BRIEF DESCRIPTION

Disclosed herein is a non-ballistic tubular perforating system. The system includes, a tubular having a wall with perforations therethrough, and plugs positioned within the perforations that are configured to dissolve in response to exposure to a first environment thereby creative of a second environment that can dissolve or increase porosity of cement.

Further disclosed herein is a method of opening perforations in a tubular system. The method includes, positioning a tubular having degradable plugs plugging perforations therein within a borehole, cementing an annular space between the tubular and the borehole with cement, exposing the degradable plugs to a first environment that dissolves the degradable plugs, dissolving the degradable plugs, exposing the cement radially of the perforations to a second environment that dissolves or increases porosity of the cement, and opening an inside of the tubular to fluid communication with the borehole through the perforations and openings or porous channels dissolved in the cement.

Further disclosed herein is a non-ballistic tubular perforating system. The system includes a tubular having a wall with perforations therethrough, plugs positioned within the perforations configured to dissolve in response to exposure to a first environment, and bristles oriented radially of the tubular proximate the perforations configured to be degradably removed to leave radial channels through cement surrounding the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
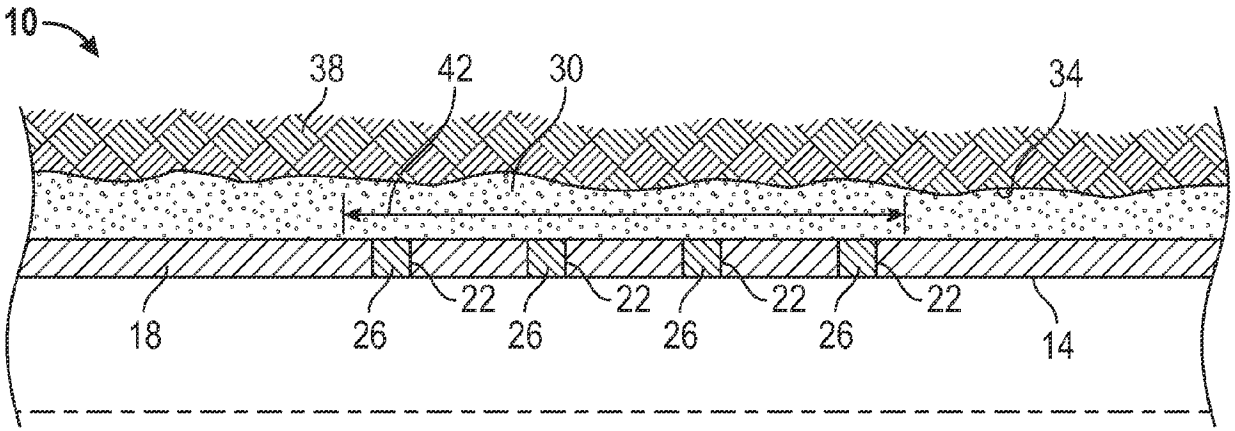
FIG. 1 depicts a partial side cross sectional view of a non-ballistic tubular perforating system disclosed herein in a plugged condition.

Referring to FIG. 1, an embodiment of a non-ballistic tubular perforating system disclosed herein is illustrated at 10. The system 10 includes, a tubular 14 having a wall 18 with perforations 22 therethrough. Plugs 26 are positioned within the perforations 22 thereby preventing fluid from flowing therethrough. The plugs 26 are made of a material that is dissolvable in a selected environment as will be elaborated on below. Cement 30 is positionable radially of the tubular 14 in an annular space defined between the tubular 14 and a borehole 34, defining a wellbore in this embodiment, in an earth formation 38. The cement 30, at least in an area 42 positioned radially of the perforations 22, is dissolvable or becomes porous or its porosity increases when exposed to a selected environment.

Figure 2:
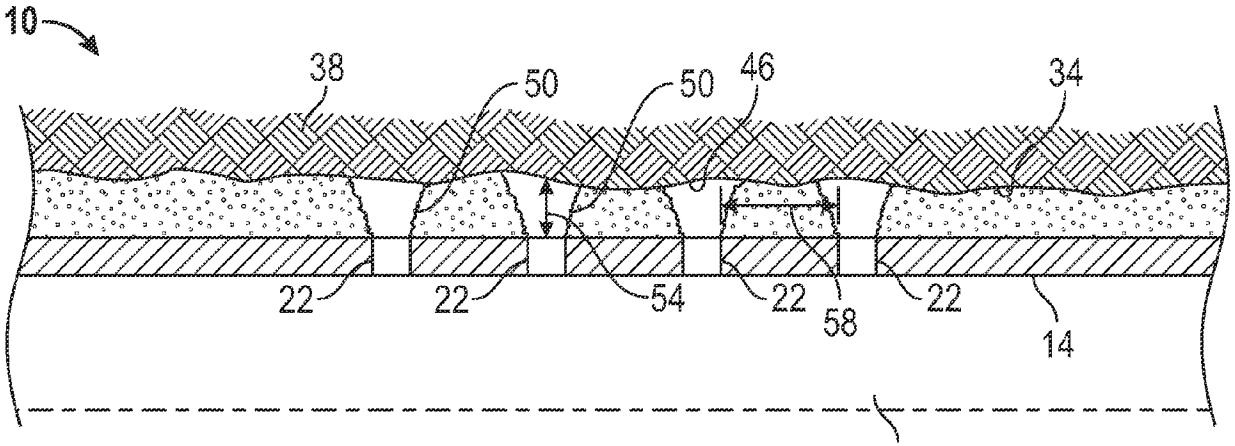
FIG. 2 depicts a partial side cross sectional view of the non-ballistic tubular perforating system of FIG. 1 in an unplugged and an open perforated condition.

Referring to FIG. 2, after dissolution of the plugs 26 and the dissolution or increase in porosity of the cement 30 positioned radially of the perforations 22 an inside 44 of the tubular 14 is in fluidic communication with walls 46 of the borehole 34 through the perforations 22 and openings or porous channels 50 in the cement 30. This configuration would allow for treatment of the earth formation 38, for example, by pumping treatment fluid down through the inside 44 of the tubular 14 out through the perforations 22 and openings or porous channels 50 and into the formation 38. Such treatments include fracturing, pumping proppant and acid treating, for example. Additionally, the system 10 would allow for production of fluids, such as hydrocarbons, for example, from the formation 38.

The plugs 26 can be made of a degradable material such as a high strength controlled electrolytic metallic material that is degradable in brine, acid, or an aqueous fluid. For example, a variety of suitable materials and their methods of manufacture are described in U.S. Patent Application Publication No. 2011/0135953 (Xu et al.), the Patent Application Publication of which is hereby incorporated by reference in its entirety. The invention is not limited to this material, however, and the plugs 26 can be made of other degradable or dissolvable materials. For example, the plugs 26 can be made of calcium carbonate or a material containing amounts of calcium carbonate sufficient to cause the plugs 26 to dissolve when exposed to a solution that causes calcium carbonate to dissolve.

Optionally, the cement 30 can also be made of materials that contribute to dissolution thereof when exposed to a second environment. Such materials can include the materials employed in the plugs 26 described above, for example, if the cement 30 is made more highly degradable it could be made so only in the area 42. In so doing, the operator can provide further control to an amount of the cement 30 that is dissolvable or porous or increases its porosity when exposed to a particular environment, thereby better controlling what portion of the cement 30 remains and provides structural support to the walls 46 of the borehole 34.

Regardless of whether all, none or just the area 42 of the cement 30 is made of more readily degradable material or material with adjustable porosity dissolution of the cement 30 can still take place. Dissolution or increasing porosity of the cement can take place in a second environment created, at least in part, from byproducts of dissolution of the plugs 26. This second environment can also include fluid employed to form a first environment dissolvable of the plugs 26.

Additional control as to what portion of the cement 30 is dissolved or had an increase in porosity thereof can be accomplished through timing of exposure of the cement 30 to the dissolving environment. This can be done in at least a couple of different ways. One way is to only expose the cement 30 to the second environment through the perforations 22. This method assures that the cement 30 adjacent to the perforations 22 is exposed first and consequently the longest of all the cement 30.

Still further control of degradation of the cement 30 can be accomplished through dimensional parameters. This control is based on the ability of select materials to have a rate of depth of dissolution that is proportional, perhaps linearly, with time. Under such a scenario by making a radial dimension 54 between the tubular 14 and borehole 34 in the area 42 less than half a dimension 58 between adjacent perforations 22 the openings or porous channels 50 (defined by dissolution of the cement 30) will extend first from the tubular 14 to the walls 46 before they extend to open the space between adjacent openings or porous channels 50. This may be desirable since it could leave some of the cement 30 structurally engaged between the walls 46 and the tubular 14 in the area 42.

Another embodiment could employ a second environment that is configured to dissolve the cement 30 at different rates in different directions. For example, by dissolving the cement 30 faster in radial directions than in directions orthogonal to radial, the cement 30 will form openings or porous channels 50 that are longer than they are across.

Figure 3:
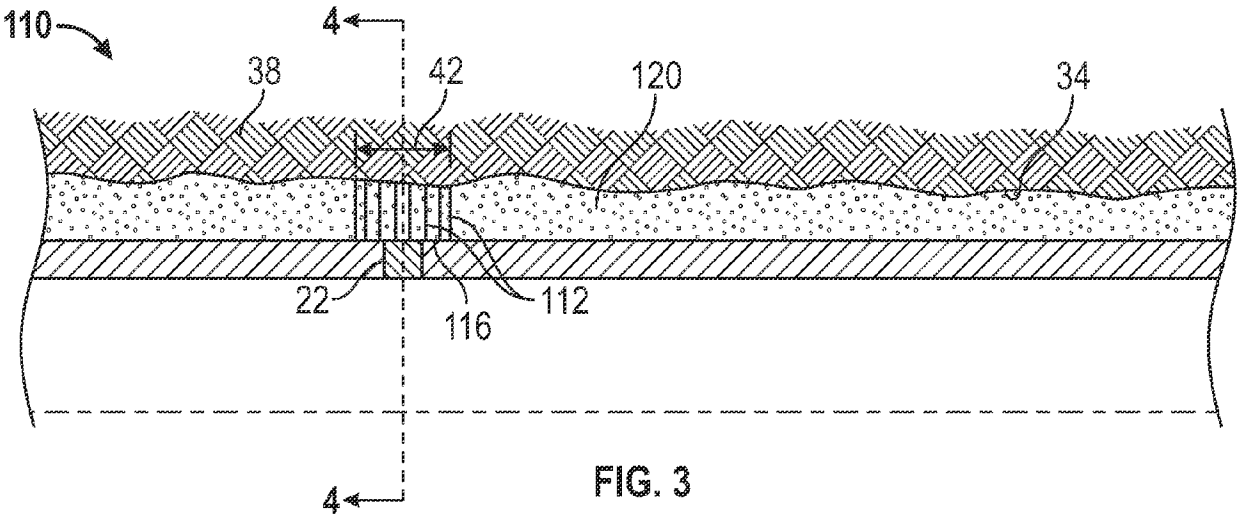
FIG. 3 depicts a partial side cross sectional view of an alternate embodiment of a non-ballistic tubular perforating system disclosed herein in a plugged condition.
Figure 4:
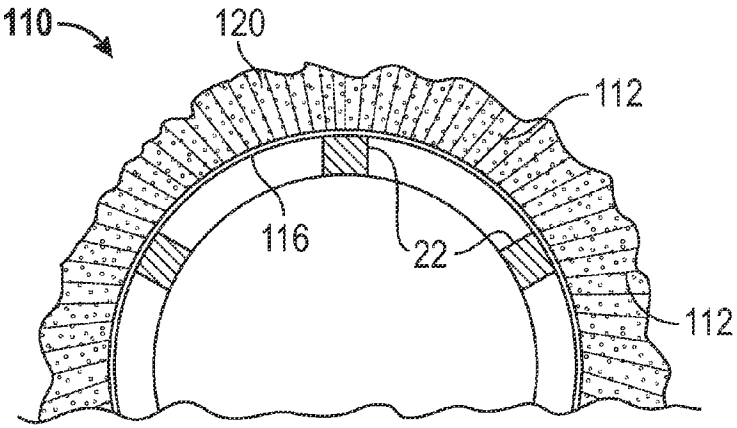
FIG. 4 depicts end cross sectional view of the non-ballistic tubular perforating system of FIG. 3 taken at arrows 4-4.

Referring to FIGS. 3 and 4 an alternate embodiment of a non-ballistic tubular perforating system disclosed herein is illustrated at 110. The system 110 differs from the system 10 in a way that the cement 30 in the area 42 is made porous. Degradablebristles 112 are positioned to extend radially outwardly of the tubular 14 in the area 42. The bristles 112 may be attached to a belt 116 that can be secured around the tubular 14 to simplify attachment of the bristles 112 to the tubular 14. The bristles 112 are flexible to allow them to bend without breaking while contacting the walls 46 of the borehole 34 while being run therethrough. The bristles 112 are made sufficiently resilient to orient themselves radially (as shown in the Figures) after cement 120 has filled the annular space between the tubular 14 and the walls 46. Since in this embodiment the bristles 112 are made of a degradable material, the cement 120 need not be. The bristles 112 can be made of a polymer, for example, that is degradable or meltable at temperature below those required to have detrimental effects on the rest of the components that make up the non-ballistic tubular perforating system 110. Once the degradable bristles 112 are degraded and essentially removed they leave voids in the cement 120 where the bristles 112 had been. These voids provide fluidic communication between the perforations 22 and the formation 38.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A non-ballistic tubular perforating system comprising:

a tubular having a wall with perforations therethrough;

plugs positioned within the perforations being reactive to a first environment and creating a second environment, the second environment being configured to dissolve or increase porosity of cement; and bristles oriented radially of the tubular proximate the perforations possing properties for degradable removal to leave radial channels through cement surrounding the tubular.

2. The method of opening perforations in a tubular system of claim 1, further comprising removing the bristles.

3. The non-ballistic tubular perforating system of claim 1, wherein the cement is positioned radially outwardly of the tubular and the plugs.

4. The non-ballistic tubular perforating system of claim 1, wherein the plugs prevent exposing the cement to the second environment until degradation thereof.

5. The non-ballistic tubular perforating system of claim 1, wherein the tubular is configured to be positioned within a borehole in an earth formation.

6. The non-ballistic tubular perforating system of claim 5, wherein fluid is flowable between the earth formation and the inside of the tubular after degradation of the plugs and degradation of the cement leaving at least an increase in porosity of a portion of the cement.

7. The non-ballistic tubular perforating system of claim 6, wherein fluid is pumpable through the perforations to treat the earth formation.

8. The non-ballistic tubular perforating system of claim 6, wherein fluid is able to flow from the earth formation through the perforations and into the tubular during production of hydrocarbons.

9. The non-ballistic tubular perforating system of claim 1, wherein the second environment is created from byproducts of the first environment and the plugs dissolved therein.

10. The non-ballistic tubular perforating system of claim 1, wherein at least one of the first environment and the second environment includes at least one of brine, an acid and an aqueous solution.

11. The non-ballistic tubular perforating system of claim 1, wherein at least one of the plugs and the cement include material that accelerates dissolution thereof.

12. The non-ballistic tubular perforating system of claim 11, wherein the material includes a high strength controlled electrolytic metallic material.

13. The non-ballistic tubular perforating system of claim 11, wherein the material includes calcium carbonate.

14. The non-ballistic tubular perforating system of claim 1, wherein the tubular is sized relative to a borehole that the tubular is positionable within such that a radial dimension between walls of the borehole and the perforations is less than half a smallest dimension between adjacent perforations.

15. The non-ballistic tubular perforating system of claim 1, wherein the second environment dissolves or increases porosity of the cement at a faster rate radially than in directions orthogonal to radially.

16. The non-ballistic tubular perforating system of claim 1, wherein the first environment is controlled by positioning of a first fluid and the second environment is controlled by positioning of a second fluid with byproducts of dissolution of the plugs.

17. The non-ballistic tubular perforating system of claim 1, wherein a depth of dissolution of the cement is proportional to time of exposure to the second environment.

18. A method of opening perforations in a tubular system comprising:

positioning a tubular having degradable plugs plugging perforations therein within a borehole;

cementing an annular space between the tubular and the borehole with cement;

exposing the degradable plugs to a first environment that dissolves the degradable plugs;

dissolving the degradable plugs;

creating a second environment configured to dissolve or increase porosity of the cement with the dissolution of the degradable plugs;

exposing the cement radially of the perforations to the second environment;

dissolving or increasing porosity of the cement; opening an inside of the tubular to fluid communication with the borehole through the perforations and openings or porous channels in the cement and cement; and displacing radial channels through the cement with bristles.

19. The method of opening perforations in a tubular system of claim 18, wherein the exposing the degradable plugs includes pumping a fluid through the tubular to the perforations to create the first environment at the degradable plugs configured to dissolve the degradable plugs.

20. The method of opening perforations in a tubular system of claim 18, further comprising exposing the cement to the second environment only after the plugs have dissolved.

21. The method of opening perforations in a tubular system of claim 18, wherein the second environment is created at least in part from dissolution of the degradable plugs.

22. The method of opening perforations in a tubular system of claim 18, further comprising withdrawing the second environment from the cement after a selected time to discontinue further dissolution of the cement.

23. A non-ballistic tubular perforating system comprising:

a tubular having a wall with perforations therethrough;

plugs positioned within the perforations being configured to dissolve in response to exposure to a first environment; and bristles oriented radially of the tubular proximate the perforations possing properties for degradable removal to leave radial channels through cement surrounding the tubular.

* * * * *

UNITED STATES PATENT AND TRADEMARK OFFICE

CERTIFICATE OF CORRECTION

PATENT NO. : 8,967,276 B2
APPLICATION NO. : 13/352969
DATED : March 3, 2015
INVENTOR(S) : Oleg A. Mazyar et al.

It is certified that error appears in the above-identified patent and that said Letters Patent is hereby corrected as shown below:

On the title page, in item (56), in column 2, under "Other Publications", line 3, delete "Presentaton" and insert -- Presentation --, therefor.

In the Specification

In column 3, line 28, delete "Degradablebristles" and insert -- Degradable bristles --, therefor.

In the Claims

In column 4, line 13, in claim 1, delete "possing" and insert -- posing --, therefor.

In column 5, line 20, in claim 18, delete "the cement and" and insert -- the --, therefor.

In column 6, line 21, in claim 23, delete "possing" and insert -- posing --, therefor.

Signed and Sealed this
Eighth Day of September, 2015

Michelle K. Lee

Michelle K. Lee
*Director of the United States Patent and Trademark Office*